US009743165B2

(12) United States Patent
Mordechai

(10) Patent No.: US 9,743,165 B2
(45) Date of Patent: Aug. 22, 2017

(54) METHOD OF FLAT MEMBRANE SPEAKER INSTALLATION

(71) Applicant: Oren Mordechai, Ramat Hasharon (IL)

(72) Inventor: Oren Mordechai, Ramat Hasharon (IL)

( * ) Notice: Subject to any disclaimer, the term of this patent is extended or adjusted under 35 U.S.C. 154(b) by 103 days.

(21) Appl. No.: 14/992,573

(22) Filed: Jan. 11, 2016

(65) Prior Publication Data

US 2016/0205454 A1 Jul. 14, 2016

Related U.S. Application Data

(60) Provisional application No. 62/102,275, filed on Jan. 12, 2015.

(51) Int. Cl.
*H04R 1/02* (2006.01)
*H04R 9/06* (2006.01)

(52) U.S. Cl.
CPC ..... *H04R 1/025* (2013.01); *H04R 2201/021* (2013.01)

(58) Field of Classification Search
CPC ..... H04R 1/025; H04R 2201/021
USPC ..... 381/332
See application file for complete search history.

(56) References Cited

U.S. PATENT DOCUMENTS 4,860,369 A * 8/1989 Koshimura ..... H04R 1/025 181/148

* cited by examiner

*Primary Examiner* — Paul S Kim
(74) *Attorney, Agent, or Firm* — Hauptman Ham, LLP

(57) ABSTRACT

A method of mounting a speaker to a wall having an opening defined therein includes attaching a top portion of the speaker to the wall. The top portion of the speaker is attached to the wall by a first clip. The method also includes swinging a bottom portion of the speaker toward the wall with the wall at an upper side of the opening between the top portion of the speaker and the first clip until a space between the bottom portion of the speaker and a second clip is substantially aligned with the wall at a lower side of the opening. The method further includes sliding the speaker away from the wall at the upper side of the opening to cause the wall at the lower side of the opening to be between the bottom portion of the speaker and the second clip.

20 Claims, 5 Drawing Sheets

METHOD OF FLAT MEMBRANE SPEAKER INSTALLATION

PRIORITY CLAIM

The present application claims priority to U.S. Provisional Patent Application No. 62/102,275, filed Jan. 12, 2015, which is incorporated herein by reference in its entirety.

BACKGROUND

Wall-mounted audio speakers are often difficult to install and unsightly. Sometimes, audio speakers such as membrane-type audio speakers require special tools for installation. Additionally, membrane-type audio speakers sometimes tighten or loosen over time, which changes sound quality.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
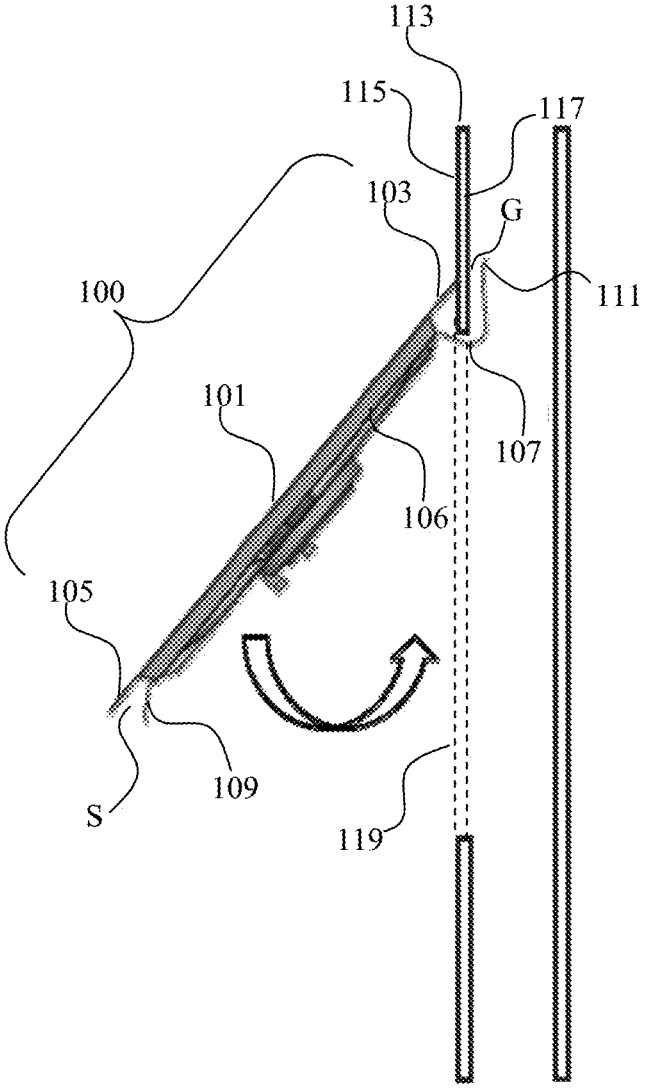
FIG. 1 is a side view diagram of a wall-mountable speaker being installed, in accordance with one or more embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Wall-mounted audio speakers sometimes require special tools for installation, which can be time consuming and inconvenient. Membrane-type audio speakers are often flush mounted against a wall, but the installation can be difficult and time consuming. Additionally, membrane-type audio speakers are sometimes intentionally or unintentionally pierced during or for installation, which can alter the sound quality output by the speaker. Further, membrane-type audio speakers sometimes tighten or loosen over time, which also changes sound quality.

FIGS. 1-5 provide an apparatus and method for mounting/installation of a flat membrane loudspeaker in hidden, and semi hidden wall configurations without the use of tools, or special fittings, and without the need to pierce the membrane surface, thus creating a complete continuity between the wall and the flat membrane of the speaker. This continuity contributes to both aesthetic and/or acoustic performance of the speaker.

Moreover, this installation system and method allows the flat membrane speaker to tighten over time. In some embodiments, the combination of a lever-clipping action and/or a weight of the speaker, even if the wall is compressed and worn out over time, causes the membrane portion of the speaker to continuously adapt to the wall at all times.

FIG. 1 is a side view diagram of a wall-mountable speaker 100 being installed, in accordance with one or more embodiments.

Speaker 100 comprises a sound emitting portion 101, a top portion 103 and a bottom portion 105. In at least some embodiments, speaker 100 is rectangular-shaped when viewed from the front. In at least some embodiments, speaker 100 is circular-shaped. In at least some embodiments, speaker 100 has a polygonal shape. In at least some embodiments, speaker 100 is irregular-shaped. The sound emitting portion 101, the top portion 103 and the bottom portion 105 are attached to a body portion 106 having sidewalls. The speaker 100 has a first clip 107 attached to a first sidewall of the body portion 106 and a second clip 109 attached to a second sidewall of the body portion 106. In some embodiments, the first clip 107 has a flange portion 111 at an end of the first clip 107. In at least some embodiments, the flange portion 111 is distal from the end of the first clip 107 connected to body portion 106.

Speaker 100 is configured to be mounted to a wall 113. The wall 113 has a front surface 115, a back surface 117, and an opening 119 defined therein. In at least some embodiments, opening 119 has a similar shape as body portion 106. In at least some embodiments, opening 119 has a different shape from body portion 106 and a size sufficient to receive body portion 106 therein. In at least some embodiments, speaker 100 also comprises left and right side portions extending away from body portion 106 and similar to top portion 103 and bottom portion 105 to overlap wall 113.

The sound emitting portion 101 is configured to face away from the front surface 115 of wall 113 if the speaker 100 is mounted to the wall 113. The top portion 103 is configured to be in contact with the front surface 115 of the wall 113 if the speaker 100 is mounted to the wall 113. The bottom portion 105 is configured to be in contact with the front surface 115 of the wall 113 if the speaker 100 is mounted to the wall 113. The body portion 106, first sidewall of the body portion 106, and the second sidewall of the body portion 106 are configured to be accommodated inside the opening 119 in the wall 113 if the speaker 100 is mounted to the wall 113.

The first clip 107 is configured to be in contact with the back surface 117 of the wall 113 inside the opening 119 if the speaker 100 is mounted to the wall 113. The second clip 109 is configured to be in contact with a back surface 117 of the wall 113 inside the opening 119 if the speaker 100 is mounted to the wall 113. The first clip 107 has a different shape compared to the second clip 109. At least one of the first clip 107 or the second clip 109 is a spring clip configured to flex during a process of mounting the speaker 100 to the wall 113. In at least some embodiments, both of the first clip 107 and the second clip 109 are spring clips. In some embodiments, the clips are made of a non-metallic, spring-like material. In some embodiments, the clips are made of a metal spring-like material.

The first clip 107 has a hook-shape. In other embodiments, the first clip 107 has a different shape. In at least some embodiments, first clip 107 has a U-shape. The end of the first clip 107 is separated from the top portion 103 of the speaker 100 by a gap G configured to substantially accommodate the wall 113 between the top portion 103 and the first clip 107 if the speaker 100 is mounted to the wall 113. The flange portion 111 is configured to contact the back surface 117 of the wall 113 if the speaker 100 is mounted to the wall 113. The first clip 107 is configured to exert a force against the back surface 117 of the wall 113 to pinch the wall 113 between the top portion 103 of the speaker 100 and the first clip 107. In at least some embodiments, a majority of the first clip 107 between body portion 106 and flange portion 111 are not in contact with wall 113.

An end of the second clip 109 is separated from the bottom portion 105 of the speaker 100 by a space S configured to substantially accommodate the wall 113 between the bottom portion 105 and the second clip 109 if the speaker 100 is mounted to the wall 113.

The first clip 107, the top portion 103 of the speaker 100, the second clip 109 and the bottom portion 105 of the speaker 100 are configured to substantially flush-mount the top portion 103 of the speaker 100 to the front surface 115 of the wall 113 and the bottom portion 105 of the speaker 100 to the front surface 115 of the wall 113. The first clip 107, the top portion 103 of the speaker 100, the second clip 109 and the bottom portion 105 of the speaker 100 are configured to flexibly attach the speaker 100 to the wall 113 such that if the speaker 100 is mounted to the wall 113, at least the first clip 107 and the second clip 109 flex based on an expansion or a contraction of the wall 113 to maintain the substantially flush-mount between the top portion 103 of the speaker 100 and the front surface 115 of the wall 113 and the bottom portion 105 of the speaker 100 and the front surface 115 of the wall 113.

In some embodiments, the sound emitting portion 101 of the speaker 100 comprises a membrane. In some embodiments, the membrane is a flexible polymer or metal material. The first clip 107 and the top portion 103 of the speaker 100 are configured to fix the speaker 100 to the wall 113 such that, if the speaker 100 is mounted to the wall 113, the membrane of the sound emitting portion 101 is tightened by at least a gravitational pull on the speaker 100. In some embodiments, the first clip 107 and the top portion 103 of the speaker 100 are configured to fix the speaker 100 to the wall 113 such that, if the speaker 100 is mounted to the wall 113, the membrane of the sound emitting portion 101 is optionally tightened by at least a gravitational pull on the speaker 100. In some embodiments, the first clip 107 and the top portion 103 of the speaker 100 are configured to fix the speaker 100 to the wall 113, and the membrane of the sound emitting portion 101 is optionally tightened by pulling on the top portion 103, the bottom portion 105 and/or a side portion of the speaker 100, by tightening one or more screws, fasteners and/or other suitable tightening devices that are attached to the membrane of the sound emitting portion 101 and/or to the top portion 103, the bottom portion 105, the side portion, or the body portion 106 of the speaker 100, or by way of some other suitable method usable to tighten the membrane of the sound emitting portion 101. In some embodiments, the top portion 103 of the speaker 100 and the bottom portion 105 of the speaker 100 comprise the same membrane as the sound emitting portion 101 of the speaker 100. The first clip 107, the top portion 103 of the speaker 100, the second clip 109 and the bottom portion 105 of the speaker 100 are configured to substantially flush-mount the top portion 103 of the speaker 100 and the bottom portion 105 of the speaker 100 to the front surface 115 of the wall 113 without piercing the membrane.

In FIG. 1, the speaker 100 is illustrated during a mounting process. The wall 113 is accommodated between the top portion 103 of the speaker 100 and the first clip 107. While the wall is between the top portion 103 and the first clip 107, the bottom portion 105 of the speaker 100 is swung toward the wall 113 at a lower side of the opening 119. The swinging of the bottom portion 105 results in a levering action that causes the wall 113 to be pinched between the flange portion 111 of the first clip 107 and the top portion 103 such that the speaker 100 is attached to the wall 113 at an upper side of the opening 119.

Figure 2:
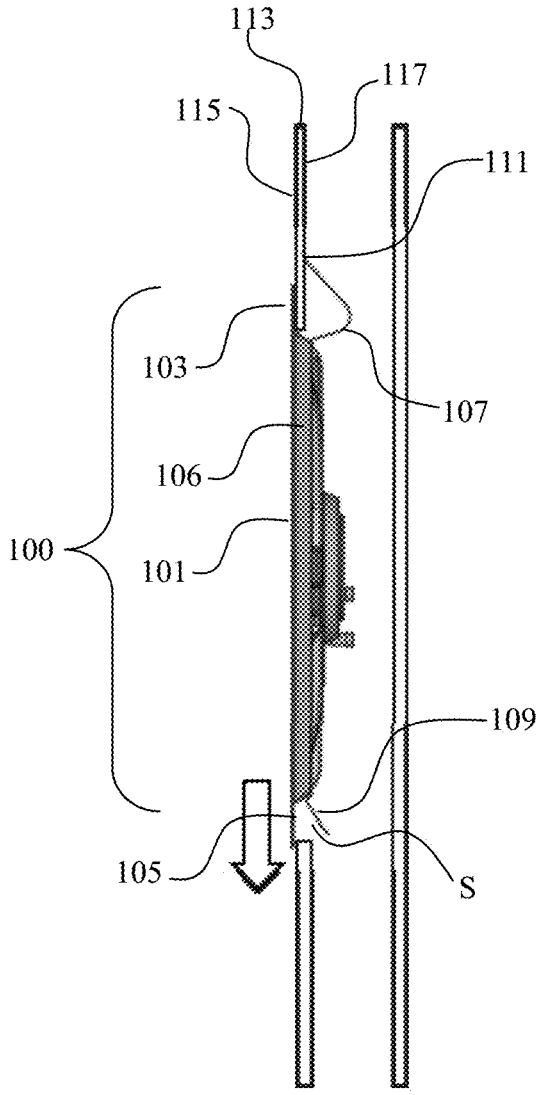
FIG. 2 is a side view diagram of a wall-mountable speaker being installed, in accordance with one or more embodiments.

FIG. 2 is a side view diagram of the wall-mountable speaker 100 being installed, in accordance with one or more embodiments.

The bottom portion 105 is swung toward the wall 113 at the lower side of the opening 119 (FIG. 1) until the space S between the bottom portion 105 of the speaker 100 is substantially aligned with the wall 113 at the lower side of the opening 119. In some embodiments, the bottom portion 105 contacts the front surface 115 of the wall 113 when the space S is substantially aligned with the wall 113 at the lower side of the opening 119. When aligned, the top portion 103 of the speaker 100 is in contact with the front surface 115 of the wall 113 and the flange portion 111 of the first clip 107 is in contact with the rear surface 117 of the wall 113 inside the opening 119. At this point in the mounting process, at least the top portion 103 of the speaker 100 is substantially flush with front surface 115 of the wall 113. In some embodiments, at least the top portion 103 of the speaker 100 and the bottom portion 105 of the speaker 100 are substantially flush with front surface 115 of the wall 113. In some embodiments, the sound emitting portion 101 is coplanar with the top portion 103 and the bottom portion 105 of the speaker 100, so that the sound emitting portion is substantially flush with the front surface 115 of the wall 113.

After the space S is substantially aligned with the wall 113 at the lower side of the opening 119, the speaker 100 is slid away from the wall 113 at the upper side of the opening 119 such that the wall 113 at the lower side of the opening is between the bottom portion 105 of the speaker 100 and the second clip 109. Sliding the speaker 100 toward the wall 113 at the lower side of the opening 119 causes the second clip 109 to flex and exert a force against the wall 113 such that the wall 113 is simultaneously pinched between the bottom portion 105 of the speaker 100 and the second clip 109, and between the top portion 103 of the speaker 100 and the first clip 107. The simultaneous pinching causes the speaker 100 to be attached and locked to the wall 113.

Figure 3:
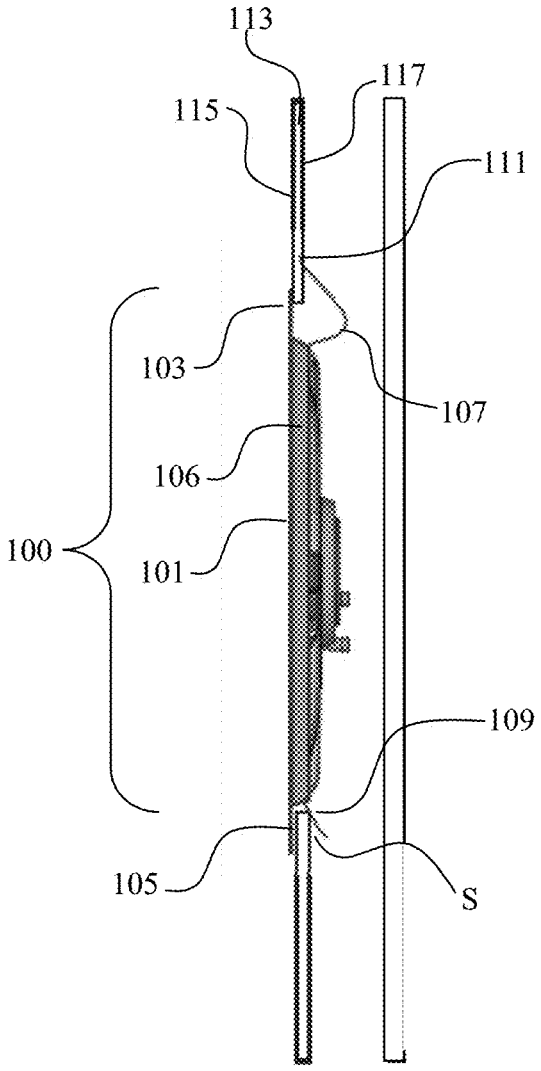
FIG. 3 is a side view diagram of a wall-mountable speaker being installed, in accordance with one or more embodiments.

FIG. 3 is a side view diagram of the wall-mountable speaker 100 after being installed, in accordance with one or more embodiments.

In FIG. 3, the speaker 100 is mounted to the wall 100 such that the wall 113 is between the top portion 103 of the speaker 100 and the first clip 107, the wall 113 is between the bottom portion 105 of the speaker 100 and the second clip 109, and the top portion 103, the bottom portion 105 and the sound emitting portion 101 are substantially flush-mounted with the front surface 115 of the wall 113.

Due to the weight of the speaker 100, a tight and prolonged lock (mount) evolves thereby creating a complete continuity between the wall and the speaker 100.

Figure 4:
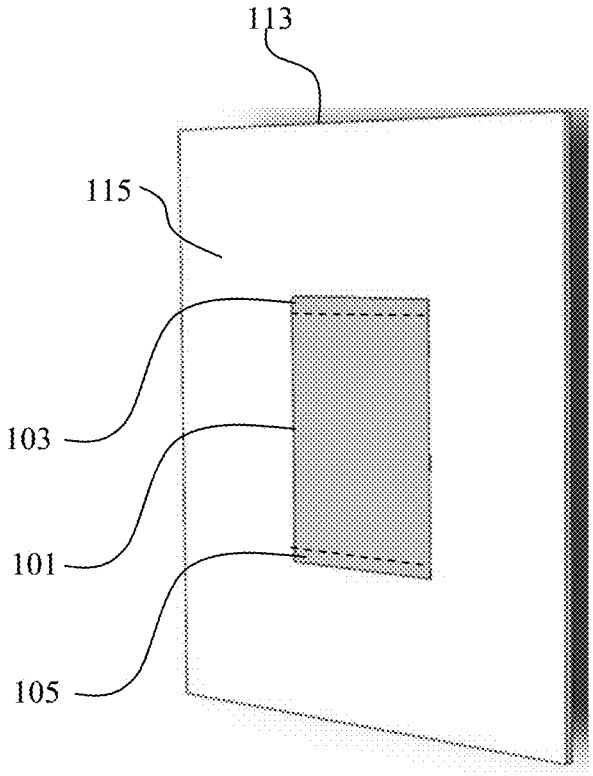
FIG. 4 is a perspective view of a wall-mountable speaker installed, in accordance with one or more embodiments.

FIG. 4 is a perspective view of the wall-mountable speaker 100, in accordance with one or more embodiments.

In FIG. 4, the top portion 103, the bottom portion 105 and the sound emitting portion 101 are substantially flush-mounted with the front surface 115 of the wall 113.

Figure 5:
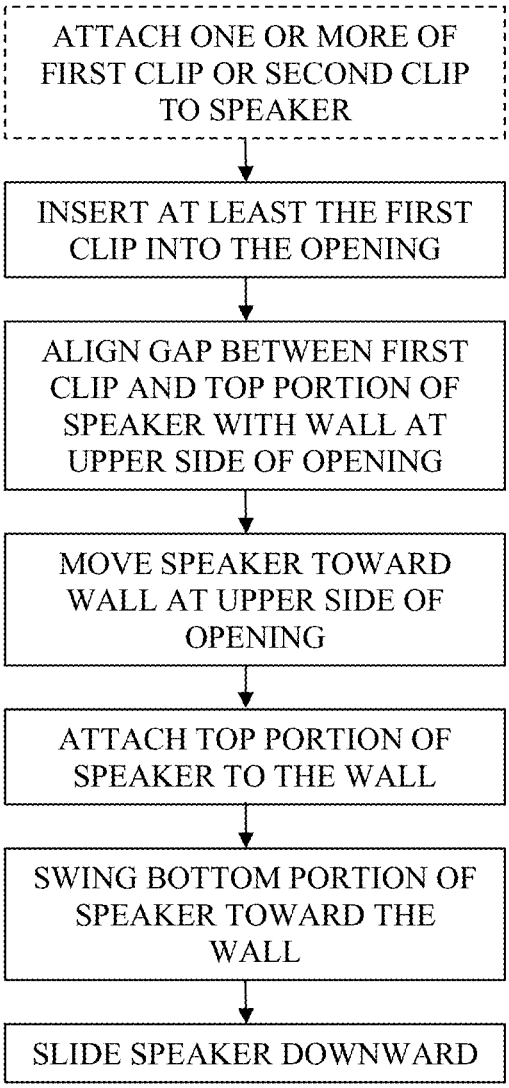
FIG. 5 is a method of installing a wall-mountable speaker, in accordance with one or more embodiments.

FIG. 5 is a flowchart of a method 500 of mounting a wall-mountable speaker such as speaker 100 (FIG. 1) to a wall having an opening defined therein, in accordance with one or more embodiments.

In step 501, one or more of a first clip is attached to an upper sidewall of the speaker or a second clip is attached to a lower sidewall of the speaker. In some embodiments, the speaker comprises a membrane configured to be substantially flush-mounted with a front surface of the wall and sidewalls configured to be accommodated inside the opening, and one or more of the first clip is attached to the upper sidewall of the speaker without piercing the membrane or the second clip is attached to the lower sidewall of the speaker without piercing the membrane. In some embodiments, one or more of the first clip or the second clip are attached to the speaker prior to beginning the mounting process. As such, step 501 is optional.

In step 503, at least the first clip is inserted into the opening.

In step 505, a gap between a top portion of the speaker and the first clip is substantially aligned with the wall at an upper side of the opening.

In step 507, at least the speaker is moved toward the wall at the upper side of the opening to cause the wall to be between the top portion of the speaker and the first clip.

In step 509, the top portion of the speaker is attached to the wall. The top portion of the speaker is attached to the wall at the upper side of the opening by way of the first clip attached to the speaker and the top portion of the speaker. The first clip is configured to allow the top portion of the speaker to contact a front surface of the wall outside the opening at an angle while the first clip is accommodated behind a back surface of the wall inside the opening. The wall at the upper side of the opening is between the top portion of the speaker and the first clip. In some embodiments, the wall at the upper side of the opening is pinched between the top portion of the speaker and the first clip.

In step 511, a bottom portion of the speaker is swung toward the wall with the wall at the upper side of the opening between the top portion of the speaker and the first clip until a space between the bottom portion of the speaker and the second clip is substantially aligned with the wall at a lower side of the opening. In some embodiments, when the space between the bottom portion of the speaker and the second clip is substantially aligned with the wall at the lower side of the opening, the bottom portion of the speaker is in contact with the wall. In some embodiments, swinging the bottom portion of the speaker toward the wall causes the first clip to press against the back surface of the wall, pinching the wall between the top portion of the speaker and the first clip.

In step 513, the speaker is slid away from the wall at the upper side of the opening to cause the wall at the lower side of the opening to be between the bottom portion of the speaker and the second clip. In some embodiments, sliding the speaker away from the wall at the upper side of the opening causes the bottom portion of the speaker to be in contact with the front surface of the wall outside the opening and the second clip to be in contact with the back surface of the wall inside the opening.

In some embodiments, the speaker comprises a membrane, and sliding the speaker away from the wall at the upper side of the opening causes the membrane to be tightened. In some embodiments, sliding the speaker away from the wall at the upper side of the opening causes the top portion of the speaker and the bottom portion of the speaker to be substantially flush-mounted with respect to the front surface of the wall. In some embodiments, if the speaker comprises a membrane, attaching the top portion of the speaker to the wall, swinging the bottom portion of the speaker toward the wall, and sliding the speaker away from the wall at the upper side of the opening causes the speaker to be substantially flush-mounted with the front surface of the wall without piercing the membrane.

An aspect of this description is related to a method of mounting a speaker to a wall having an opening defined therein. The method comprises attaching a top portion of the speaker to the wall, the top portion of the speaker being attached to the wall at an upper side of the opening by way of a first clip attached to the speaker. The first clip is configured to allow the top portion of the speaker to contact a front surface of the wall outside the opening at an angle while the first clip is accommodated behind a back surface of the wall inside the opening. The wall at the upper side of the opening is between the top portion of the speaker and the first clip. The method also comprises swinging a bottom portion of the speaker toward the wall with the wall at the upper side of the opening between the top portion of the speaker and the first clip until a space between the bottom portion of the speaker and a second clip is substantially aligned with the wall at a lower side of the opening. The method further comprises sliding the speaker away from the wall at the upper side of the opening to cause the wall at the lower side of the opening to be between the bottom portion of the speaker and the second clip.

The foregoing outlines features of several embodiments so that those of ordinary skill in the art may better understand the aspects of the present disclosure. Those of ordinary skill in the art should appreciate that they may readily use the present disclosure as a basis for designing or modifying other circuits, processes and structures for carrying out the same purposes and/or achieving the same advantages of the embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

What is claimed is:

1. A method of mounting a speaker to a wall having an opening defined therein, the method comprising:

attaching a top portion of the speaker to the wall, the top portion of the speaker being attached to the wall at an upper side of the opening by way of a first clip attached to the speaker, the first clip being configured to allow the top portion of the speaker to contact a front surface of the wall outside the opening at an angle while the first clip is accommodated behind a back surface of the wall inside the opening, wherein the wall at the upper side of the opening is between the top portion of the speaker and the first clip;

swinging a bottom portion of the speaker toward the wall with the wall at the upper side of the opening between the top portion of the speaker and the first clip until a space between the bottom portion of the speaker and a second clip is substantially aligned with the wall at a lower side of the opening; and sliding the speaker away from the wall at the upper side of the opening to cause the wall at the lower side of the opening to be between the bottom portion of the speaker and the second clip.

2. The method of claim 1, wherein when the space between the bottom portion of the speaker and the second clip is substantially aligned with the wall at the lower side of the opening, the bottom portion of the speaker is in contact with the wall.

3. The method of claim 1, wherein sliding the speaker away from the wall at the upper side of the opening causes the bottom portion of the speaker to be in contact with the front surface of the wall outside the opening and the second clip to be in contact with the back surface of the wall inside the opening.

4. The method of claim 1, further comprising:

inserting at least the first clip into the opening;

substantially aligning a gap between the top portion of the speaker and the first clip with the wall at the upper side of the opening; and moving at least the speaker toward the wall at the upper side of the opening to cause the wall to be between the top portion of the speaker and the first clip.

5. The method of claim 1, wherein swinging the bottom portion of the speaker toward the wall causes the first clip to press against the back surface of the wall, pinching the wall between the top portion of the speaker and the first clip.

6. The method of claim 1, wherein the speaker comprises a membrane, and sliding the speaker away from the wall at the upper side of the opening causes the membrane to be tightened.

7. The method of claim 1, wherein sliding the speaker away from the wall at the upper side of the opening causes the top portion of the speaker and the bottom portion of the speaker to be substantially flush-mounted with respect to the front surface of the wall.

8. The method of claim 7, wherein the speaker comprises sidewalls configured to be accommodated inside the opening, and the method further comprises:

attaching one or more of the first clip to an upper sidewall of the speaker or the second clip to a lower sidewall of the speaker.

9. The method of claim 1, wherein the speaker comprises a membrane configured to be substantially flush-mounted with the front surface of the wall and sidewalls configured to be accommodated inside the opening, and the method further comprises:

attaching one or more of the first clip to an upper sidewall of the speaker or the second clip to a lower sidewall of the speaker without piercing the membrane.

10. The method of claim 1, wherein the speaker comprises a membrane, and attaching the top portion of the speaker to the wall, swinging the bottom portion of the speaker toward the wall, and sliding the speaker away from the wall at the upper side of the opening causes the speaker to be substantially flush-mounted with the front surface of the wall without piercing the membrane.

11. A wall-mountable speaker, comprising:

a sound emitting portion configured to face away from a front surface of a wall if the speaker is mounted to the wall;

a top portion configured to be in contact with the front surface of the wall if the speaker is mounted to the wall;

a bottom portion configured to be in contact with the front surface of the wall if the speaker is mounted to the wall;

a first sidewall configured to be accommodated inside an opening in the wall if the speaker is mounted to the wall;

a second sidewall configured to be accommodated inside the opening in the wall if the speaker is mounted to the wall;

a first clip attached to the first sidewall, wherein the first clip is configured to be in contact with a back surface of the wall inside the opening if the speaker is mounted to the wall; and a second clip attached to the second sidewall, wherein the second clip is configured to be in contact with a back surface of the wall inside the opening if the speaker is mounted to the wall, wherein the first clip has a different shape compared to the second clip.

12. The wall-mountable speaker of claim 11, wherein the first clip is a spring clip having a hook-shape, and an end of the first clip is separated from the top portion of the speaker by a gap configured to substantially accommodate the wall between the top portion and the first clip if the speaker is mounted to the wall.

13. The wall-mountable speaker of claim 12, wherein the end of the first clip has a flange portion configured to contact the back surface of the wall if the speaker is mounted to the wall, and the first clip is configured to exert a force against the back surface of the wall to pinch the wall between the top portion of the speaker and the first clip.

14. The wall-mountable speaker of claim 12, wherein an end of the second clip is separated from the bottom portion of the speaker by a space configured to substantially accommodate the wall between the bottom portion and the second clip if the speaker is mounted to the wall.

15. The wall-mountable speaker of claim 11, wherein at least the sound emitting portion of the speaker comprises a membrane.

16. The wall-mountable speaker of claim 15, wherein the first clip and the top portion of the speaker are configured to fix the speaker to the wall such that the membrane is tightened by one or more of a gravitational pull on the speaker or a mechanical tightening device.

17. The wall-mountable speaker of claim 15, wherein the first clip, the top portion of the speaker, the second clip and the bottom portion of the speaker are configured to substantially flush-mount the top portion of the speaker and the bottom portion of the speaker to the front surface of the wall without piercing the membrane.

18. The wall-mountable speaker of claim 15, wherein the top portion of the speaker and the bottom portion of the speaker comprise the same membrane as the sound emitting portion of the speaker.

19. The wall-mountable speaker of claim 11, wherein the first clip, the top portion of the speaker, the second clip and the bottom portion of the speaker are configured to substantially flush-mount the top portion of the speaker to the front surface of the wall and the bottom portion of the speaker to the front surface of the wall.

20. The wall-mountable speaker of claim 19, wherein the first clip, the top portion of the speaker, the second clip and the bottom portion of the speaker are configured to flexibly attach the speaker to the wall such that if the speaker is mounted to the wall, at least the first clip and the second clip flex based on an expansion or a contraction of the wall to maintain the substantially flush-mount between the top portion of the speaker and the front surface of the wall and the bottom portion of the speaker and the front surface of the wall.

* * * * *